US006055394A

United States Patent [19]

Suda et al.

[11] Patent Number: 6,055,394

[45] Date of Patent: Apr. 25, 2000

[54] RELIABLE COVER SWITCH EMPLOYING MACHINE

[75] Inventors: Takeo Suda, Katsushika-ku; Hiroshi Yoshinaga, Ichikawa, both of Japan

[73] Assignee: Ricoh Company, Ltd., Tokyo, Japan

[21] Appl. No.: 09/277,174

[22] Filed: Mar. 26, 1999

[30] Foreign Application Priority Data

Mar. 26, 1998 [JP] Japan ..... 10-096908

[51] Int. Cl.[7] ..... G03G 15/00

[52] U.S. Cl. ..... 399/107; 307/119; 399/125

[58] Field of Search ..... 399/9, 13, 37, 399/88, 90, 107, 110, 111, 114, 125; 312/222; 307/119, 132 EA, 139, 140, 154

[56] References Cited

U.S. PATENT DOCUMENTS

| | | | |
|---|---|---|---|
| 4,139,300 | 2/1979 | Katayama et al. | 399/18 |
| 4,166,692 | 9/1979 | Okada et al. | 399/107 |
| 4,284,345 | 8/1981 | Sugiyama et al. | 399/351 |
| 4,470,689 | 9/1984 | Nomura et al. | 399/114 |
| 4,685,709 | 8/1987 | Kambic | 307/119 X |
| 4,908,659 | 3/1990 | Ishii et al. | 399/125 |
| 5,168,308 | 12/1992 | Hiraike et al. | 399/125 |
| 5,678,125 | 10/1997 | Kutsuwada et al. | 399/26 |
| 5,815,767 | 9/1998 | Kutsuwada et al. | 399/25 |

FOREIGN PATENT DOCUMENTS 9-114332 5/1997 Japan .

*Primary Examiner*—Sophia S. Chen
*Attorney, Agent, or Firm*—Oblon, Spivak, McClelland, Maier & Neustadt, P.C.

[57] ABSTRACT

An image forming apparatus includes a body cover pivotally mounted on a body of the image forming apparatus and a switch mechanism for detecting an opening/closing status of the body cover. The switch mechanism includes a switch disposed in the body and a cam disposed beside the switch for activating the switch when rotated in a prescribed direction. The switch mechanism further includes a lever with one end supported by the body cover while another end contacts and rotates the cam by a prescribed constant amount of a rotational angle when the body cover is closed.

31 Claims, 7 Drawing Sheets

FIG. 3A
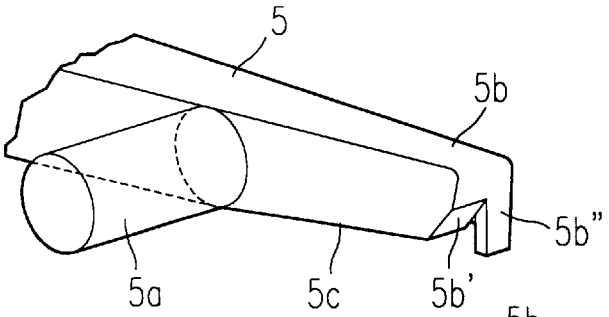
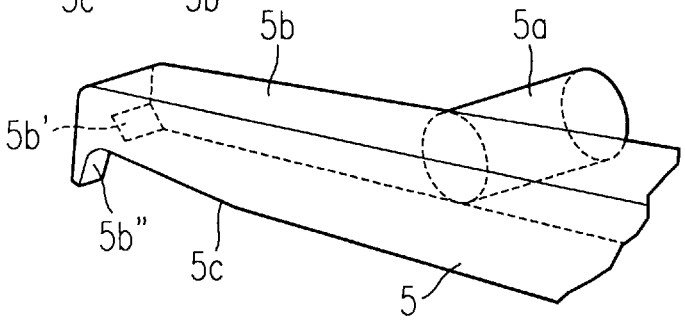
FIG. 3B
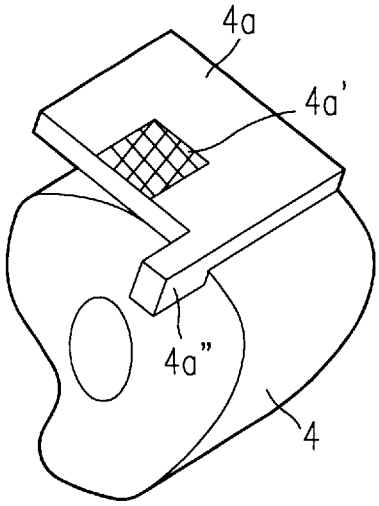
FIG. 4

RELIABLE COVER SWITCH EMPLOYING MACHINE

CROSS-REFERENCE TO RELATED APPLICATION

This application relates to Japanese Patent Application No. 10-096908, which was filed in the Japanese Patent Office on Mar. 26, 1998, and which is incorporated herein by reference.

BACKGROUND OF THE INVENTION

1. Field of the Invention

The present invention relates to a switch mechanism for use, for example, in an electrophotographic image forming apparatus such as a copier, a facsimile, a printer, and so on, and in particular, relates to a switch mechanism capable of reliably detecting an opening/closing status of a cover attached to a body of the electrophotographic image forming apparatus.

2. Discussion of the Related Art

A switch mechanism is generally utilized for detecting an opening/closing status of a cover attached to a body of the image forming apparatus. A conventional switch mechanism includes a so-called limit switch disposed in the body of the image forming apparatus, and an activating member for activating the limit switch, which is mounted on the body cover at a portion corresponding to the limit switch. The activating member generally activates the limit switch when the body cover is closed, and deactivates the same when the body cover is opened.

The activating member generally has a lever whose one end is connected with the body cover and another end which extends to an actuator of the limit switch to push. The body cover generally includes a large-sized plane plate made of plastic using a molding process. Thus, the body cover is weak in strength, and thereby tends to bend. Therefore, a leading end of the activating member hardly faces the limit switch accurately when the body cover is closed. Further, an operative distance of the limit switch is generally very small, i.e. about a few millimeters. Thus, the limit switch of the conventional switch mechanism sometimes erroneously operates.

Further, the activating member may interrupt maintenance because the activating member generally extends from the body when the body cover is opened. Further, the activating member may be damaged due to physical contact by an operator during the maintenance.

To avoid such an erroneous operation of the limit switch, parts of the switch mechanism are highly precisely manufactured. However, it generally costs very much.

Further, as described in Japanese Laid-Open Patent Application No. 8-285183, to avoid the above-mentioned problems, a guide member is disposed between a body cover and a switch to guide an activating member to the switch. Also, a folding mechanism is employed beside the guide member and is linked with the body cover. The activating member is folded by the folding mechanism to hide in a hollow portion of the body cover when the body cover is opened.

However, such a conventional switch mechanism does not always enable the activating member to activate the limit switch because a leading end of the activating member, which is required to reach the limit switch, sometimes varies its stopping position when the body cover is closed due to a nonpositional limitation of the activating member in its moving direction. As a result, the leading end sometimes does not reach the limit switch and accordingly the limit switch may erroneously operate due to an insufficient contact of the leading end. Thus, the guiding member does not determine the deepest position of the leading end.

Further, since the folding mechanism is separately employed from the switch mechanism, a construction of the image forming apparatus is complex.

SUMMARY OF THE INVENTION

An object of the present invention is therefore to address and resolve the above identified problems and to provide a new reliable cover switch employing machine. According to the invention, the above and other objects are achieved, for example, by an image forming apparatus that includes a body cover pivotally mounted on a body of the image forming apparatus, and a switch mechanism for detecting an opening/closing status of the body cover. The switch mechanism may include a switch disposed in the body, a cam disposed beside the switch, which activates the switch when rotated in a prescribed direction, and a lever whose one end is supported by the body cover. A leading end of the lever may rotate the cam by a prescribed constant amount of a rotational angle when the body cover is closed. The cam may include a plate like portion and the lever may include a straight portion at its leading portion so that the lever may slide on the plate like portion after the cam is rotated by the prescribed constant amount of a rotational angle. Thus, the cam rotates by a prescribed angle, even if a stopping position of the lever varies.

The switch may include an actuator and the cam may include a larger diameter portion for pushing the actuator by a prescribed distance to activate the switch when rotated. Thus, a reliable detection of the opening/closing status of the body cover is obtained.

In another embodiment, a contacting surface may be disposed on a leading end portion of the lever, which contacts a plate like portion of a cam, and an engaging portion is disposed beside the contacting surface, which engages with the plate like portion of the cam when the body cover starts to be closed. The plate like portion of the cam may include a contact plane to be contacted by the slant portion of the lever and may also include a projection projecting from the plate like portion to be engaged with the engaging portion of the lever. The cam is moved to an initial position when the body cover is opened.

In still another embodiment, an image forming apparatus may include an image forming unit having a shield cover pivotally mounted thereon to cover the image forming device in the unit. The shield cover may include an engaging cam in a body having a straight surface. A lever as an actuating member is provided and has a lifting member protruding therefrom. The lifting member contacts the straight surface and lifts the shield cover when the body cover is closed.

The lifting portion may slide on the straight surface and stop thereon after the shield cover is opened. Thus, the shield cover can always be opened at a prescribed angular position, even if a stopping position of the lifting portion, namely at the lever, varies.

BRIEF DESCRIPTION OF THE DRAWINGS

FIG. 3A is a schematic perspective view that illustrates a leading half portion of a lever constituting the switch mechanism illustrated in FIG. 2 when viewed from an inside of a body of an image forming apparatus;

FIG. 3B is a schematic perspective view that illustrates the leading half portion of a lever illustrated in FIG. 3A when viewed from a body cover of the image forming apparatus;

FIG. 4 is a perspective view that illustrates one example of a cam constituting the switch mechanism illustrated in FIGS. 1 and 2;

DETAILED DESCRIPTION OF THE PREFERRED EMBODIMENTS

Figure 1:
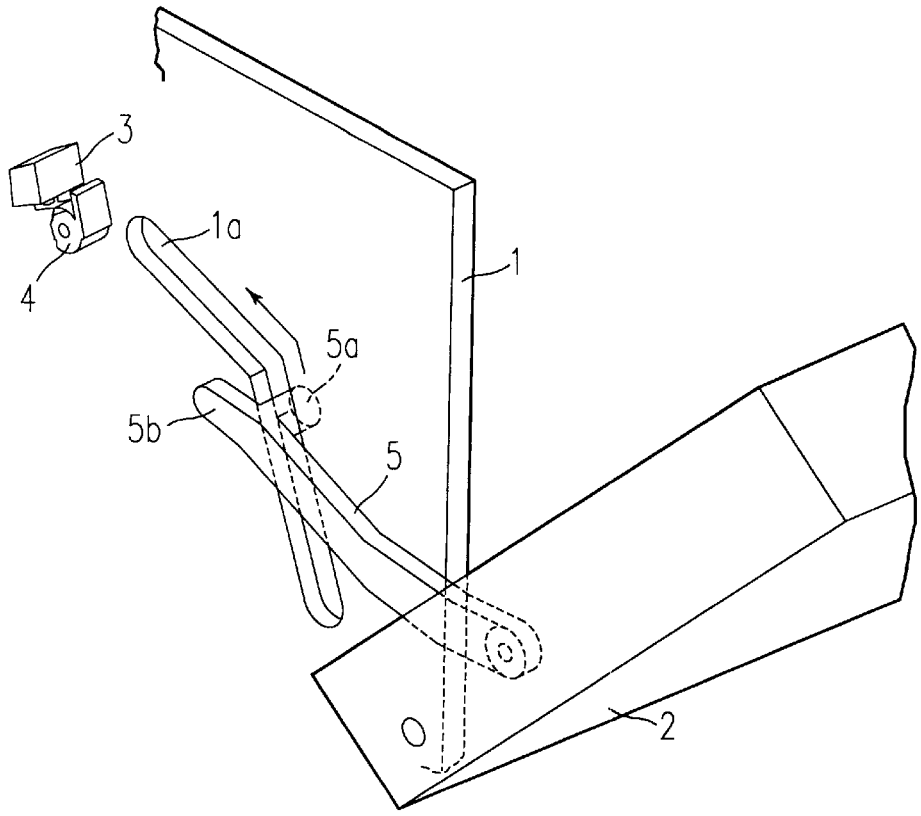
FIG. 1 is a schematic perspective view that illustrates a principal part of one embodiment of the present invention.

Hereinbelow, embodiments of the present invention are explained by referring to the several drawings. Like numbers and marks indicate identical or corresponding parts throughout the several views. As a first embodiment of the present invention, an image forming apparatus employing a switch mechanism is illustrated in FIG. 1.

As there shown, the image forming apparatus includes a body frame 1 constituting its side surface. The image forming apparatus further includes a body cover 2 freely supported by the body frame 1 at a lower portion of the body frame 1. Thus, the body cover 2 may be opened and closed with regard to a body of the image forming apparatus. The switch mechanism includes a switch 3, for example a limit switch, fixedly mounted on a prescribed portion of the body frame 1, and a cam 4 freely supported by the body frame 1 and disposed adjacent to the switch 3. The switch mechanism further includes a lever 5 for rotating the cam 4 in a prescribed direction when the body cover 2 is closed.

A base end portion of the lever 5 is freely supported by a side surface of the body cover 2. The lever 5 further includes a cylindrical fitting portion 5*a* protruding therefrom on its portion apart from the leading end by a distance of about a few centimeters. The lever 5 further includes a leading end portion 5*b* extending from the portion from which the fitting portion 5*a* protrudes. The body frame 1 includes a guide slot 1*a* for guiding the lever 5 during an opening/closing operation of the body cover 2, which is bent almost at a middle portion.

The fitting portion 5*a* may fit into the guide slot 1*a* and slides along the guide slot 1*a* when the body cover 2 is opened and closed. The guide slot 1*a* may have a prescribed bending angle so that the leading end portion 5*b* moves on a prescribed orbit during the opening and closing operation of the body cover 2. The leading end portion 5*b* moves toward the uppermost end of the guiding slot 1*a* and contacts the cam 4 disposed almost on a line extending from the guide slot 1*a* when the body cover 2 is closed. The leading end portion 5*b* rotates the cam 4 by a prescribed amount of an angle. The cam 4 then contacts and activates the limit switch 3; thereby, the limit switch 3 detects an opening/closing status of the body cover 2.

Figure 2:
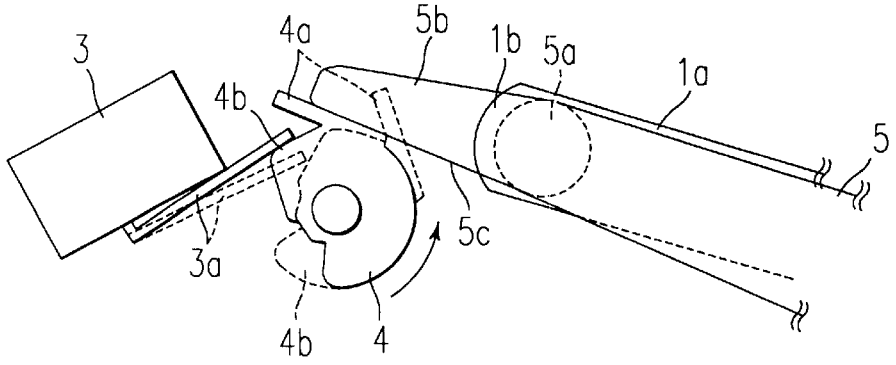
FIG. 2 is a schematic side view that illustrated a principal part of a switch mechanism illustrated in FIG. 1.

FIG. 2 illustrates a status of the switch 3 activated by the cam 4. As there shown, the switch mechanism employed in this embodiment may include the cam 4, the lever 5 and the switch 3. The cam 4 includes a plate like portion disposed on an arc of its circumference. The plate like portion has a plane plate extending on a tangent line of the circumference of the cam 4. The leading end portion 5*b* has a lower surface portion 5*c* at its lower side. The cam 4 includes an eccentric portion 4*b* having at least a larger diameter. The larger diameter portion may push an actuator 3*a* up to turn the switch 3 ON when the cam 4 is rotated around its axis.

Since FIG. 2 illustrates a status of the lever 5 and the cam 4 when the body cover 2 of FIG. 1 is completely closed, the fitting portion 5*a* almost reaches the uppermost end of the guide slot 1*a,* as shown by a dotted line in FIG. 2. Further, the leading end portion 5*b* may contact the plate like portion 4*a.* The leading end portion 5*b* may rotate the cam 4 from a position illustrated by a dotted line to that illustrated by a solid line during its pushing movement.

The cam 4 may stop its rotation when the lower end portion 5*c* comes to contact the plate like portion 4*a* in a parallel position. Since a slip occurs between the lower surface portion 5*c* and the plate like portion 4*a* when they are positioned in parallel, the cam 4 is not rotated even if the leading end portion 5*b* keeps advancing toward an inside of the body. Thus, the rotational angle of the cam 4 may be kept constant always at a prescribed amount, even if the body cover 2 of FIG. 1 or the like is insufficiently located or bent. Accordingly, the stopping position of the leading end portion 5*b* may vary when the body cover 2 is closed.

According to the above-described embodiment, an advancing movement of the leading end portion 5*b* is converted to a rotation of the cam 4 such that the cam 4 always rotates a prescribed amount of an angle. Thus, the rotation of the cam 4 may cause a displacement of a leading end of the actuator 3*a* by a prescribed constant small amount of a length. Thus, a detection of an opening/closing status of the body cover 2 can surely be executed due to the constant displacement of the actuator 3*a,* and accordingly, an erroneous detection can be avoided.

Further, as illustrated in FIG. 2, since a gap 1*b* remains between the uppermost end of the guide slot 1*a* and the fitting portion 5*a* when the body cover 2 is completely closed, the closing movement of the body cover 2 may not be interrupted by the uppermost end, even if the fitting portion 5*a* varies its stopping position by some amount.

The lever 5, with its leading end having either a cylindrical shape or a conical shape, can be used as far as it is capable of sliding the plate like portion 4*a* in a straight line.

The leading end portion 5*b* may be separated from the plate like portion 4*a* when the body cover 2 is opened. To detect the opening status of the body cover 2, the cam 4 is required to rotate inversely so that the switch 3 turns OFF. To rotate the cam 4 inversely so as to return the cam 4 to its home position illustrated by a dotted line in FIG. 2, an inversely rotating mechanism such as a spring mechanism (not shown) is generally used to rotate the cam 4 clockwise. However, a below-described embodiment does not require such a spring mechanism and employs a more simple construction.

Hereinbelow, a device for returning the cam 4 to the home position of the cam 4 is explained in detail referring to FIGS. 3 through 5. A pair of perspective schematic views of a leading end portion 5*b* of a lever 5 is illustrated in FIGS. 3A and 3B when viewed respectively from an inside of a body and a side of the body cover 2 of an image forming apparatus. As there shown, the leading end portion 5*b* includes a slant portion 5*b′* for contacting a plate like portion 4*a* of the cam 4 when the body cover 2 is closed. The slant portion 5*b′* has a slope made by cutting away a corner of an edge of the leading end portion 5*b*. The leading end portion 5*b* further includes a latch portion 5*b″* disposed beside the slant portion 5*b′* and downwardly protruding from a lower surface portion 5*c*.

A detailed construction of the cam 4 to be rotated by the leading end portion 5*b* is illustrated in FIG. 4. As there shown, the plate like portion 4*a* includes a receiving surface 4*a′* on its slope, to which the slant portion 5*b′* of FIGS. 3A and 3B contacts when the body cover 2 of FIG. 1 is closed. The plate like portion 4*a* further includes an engaging portion 4*a″* which is to be engaged by the latch portion 5*b″* and which protrudes from the plate like portion 4*a* to a side at its edge closest to the slant portion 5*b′*.

Figure 5A:
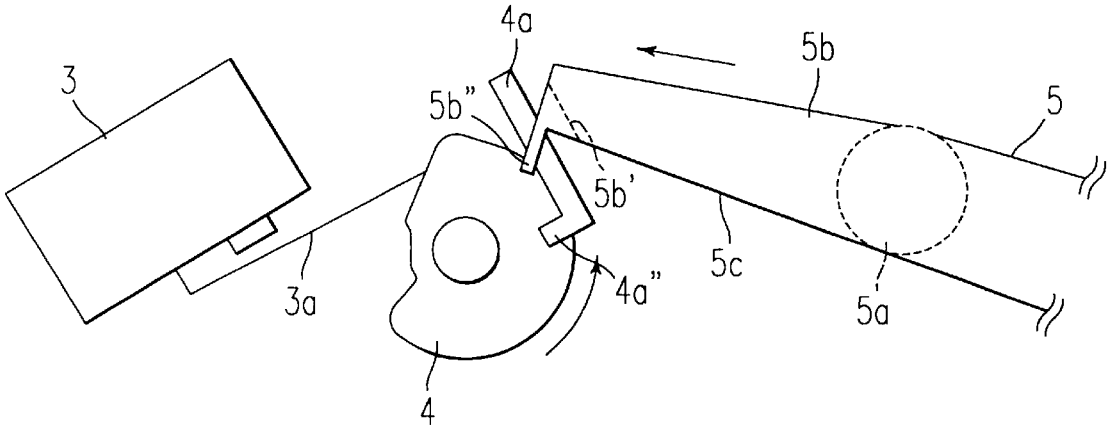
FIG. 5A is a schematic side view that illustrates a first status of a principal part of the switch mechanism when a leading end of the lever illustrated in FIGS. 3A and 3B contacts the cam illustrated in FIG. 4 after a body cover is closed.
Figure 5B:
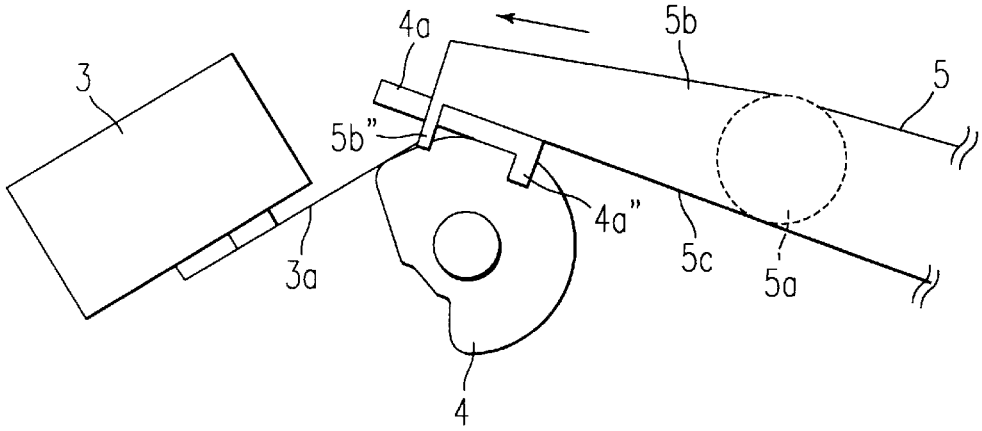
FIG. 5B is a schematic side view that illustrates a second status of the principal part of the switch mechanism when the leading end of the lever illustrated in FIGS. 3A and 3B slides on the cam illustrated in FIG. 4.

Hereinbelow, a pair of moving steps of the leading end portion 5*b* when rotating the cam 4 are explained referring to FIGS. 5A, 5B and 5C. Initially, the slant portion 5*b′* contacts the receiving surface 4*a′* when the body cover is closed, as illustrated in FIG. 5A. The cam 4 may rotate until the lower surface portion 5*c* becomes parallel with a surface of the plate like portion 4*a,* as illustrated in FIG. 5B, and slide thereon.

Figure 5C:
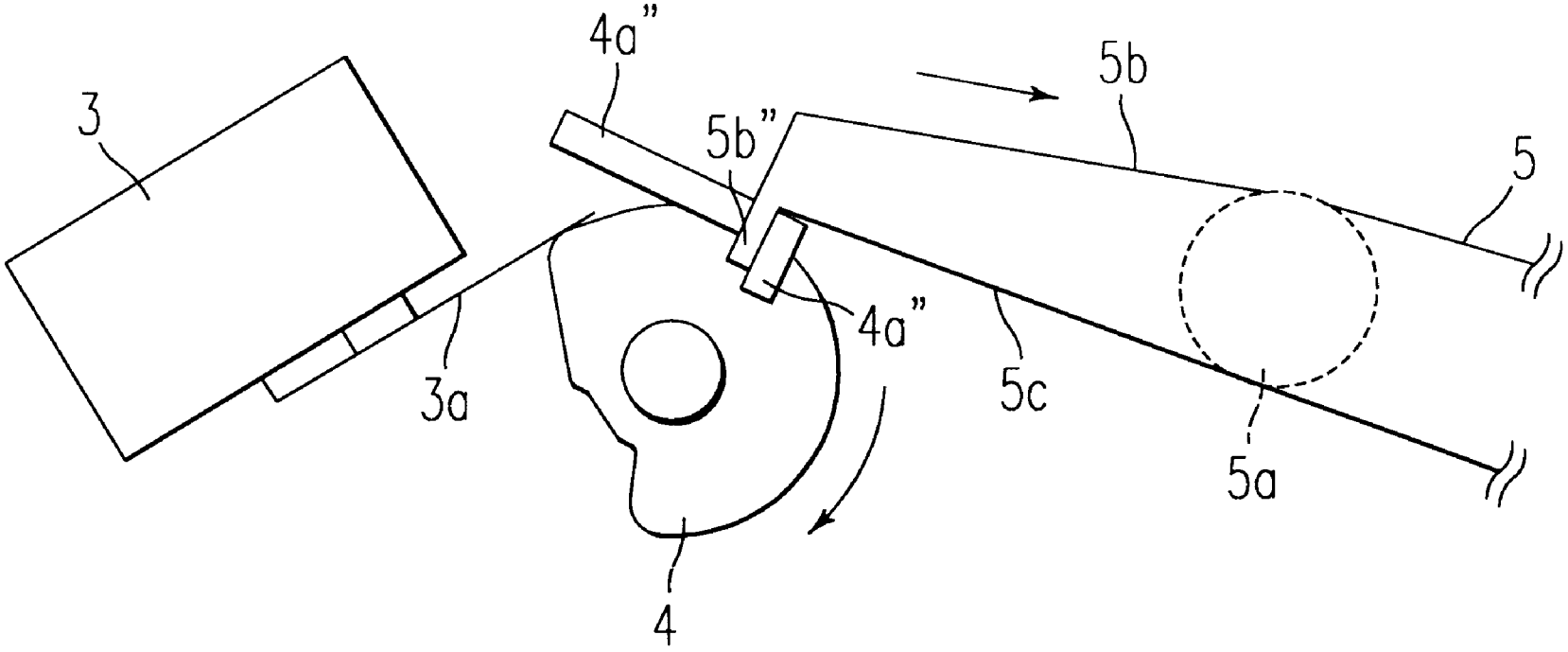
FIG. 5C is a schematic side view that illustrates a third status of the principal part of the switch mechanism when a body cover starts to be opened.

The latch portion 5*b″* may latch the engaging portion 4*a″* when the body cover starts to be opened, namely, the leading end portion 5*b* is separated from the plate like portion 4*a* to return to its opening position, as illustrated in FIG. 5C. Thus, the cam 4 is inversely rotated by the latch portion 5*b″* to return its initial position, as illustrated in FIG. 5C. Thus, a particular spring for the cam 4 to return to the initial position can be omitted.

Figure 6:
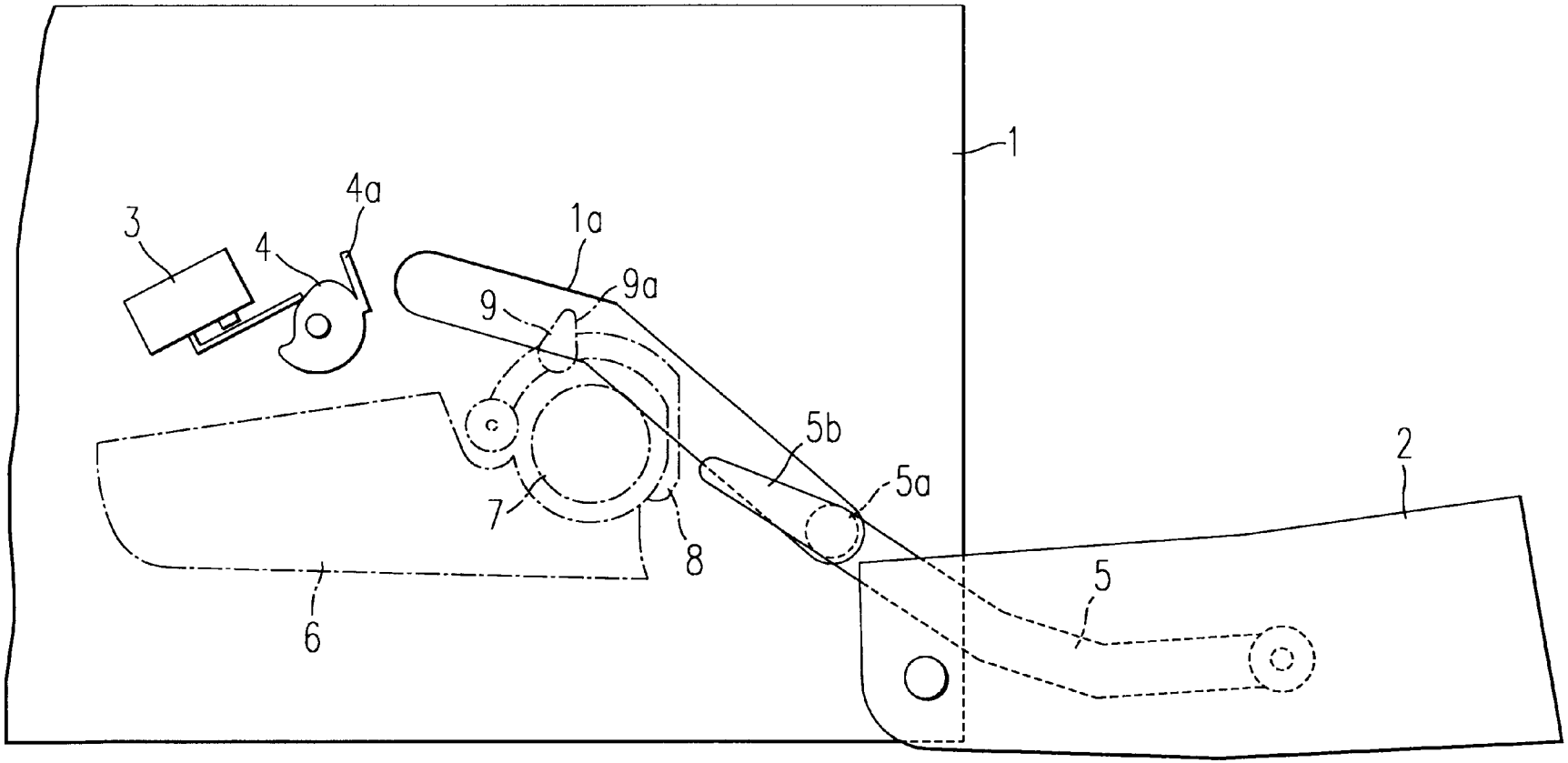
FIG. 6 is a side view that illustrates an image forming apparatus when the body cover thereof is opened and which includes the switching mechanism illustrated in the aforementioned drawings.

Hereinbelow, another embodiment is explained with reference to FIGS. 6 through 8B. An outline of a construction of the embodiment when the body cover 2 is opened is illustrated in FIG. 6. As there shown, one end of the lever 5 is rotatably supported by the body cover 2. The fitting portion 5*a* is mounted on the lever 5 and is disposed to fit into and freely slide along the guide slot 1*a* as explained earlier. Thus, since the guide slot 1*a* has two ends, it may limit a moving range of the body cover 2.

As illustrated in FIG. 6, the fitting portion 5*a* may contact the lowermost end of the guide slot 1*a*. Thereby, the body cover 2 is kept opened at a prescribed angular position. The lever 5 functions as a limit switch-activating device in FIG. 6 in the same manner as explained earlier. Thus, the lever 5 constitutes a mechanism for stopping an opening movement of the body cover 2 and supporting it at the prescribed angular position in cooperation with the guide slot 1*a*.

Further, a portion of the lever 5 extending therefrom, when the body cover 2 is opened, is required to be almost hidden in a hollow portion of the body cover 2. To hide the portion of the lever 5, the guide slot 1*a* may be disposed on the body frame 1 with its lowest end being positioned almost at the same level as a pivot of the body cover 2. Further, the pivot is attached to a side wall of the body cover 2, as illustrated in FIG. 6.

The above-mentioned devices may be employed in an image forming apparatus having a process cartridge 6, as illustrated in FIG. 6. The process cartridge 6 includes a photoconductive member 7 (hereinafter referred to as the PC member 7), a cover 8 (hereinafter referred to as the PCM cover 8), and other image forming devices. The process cartridge 6 may be set almost at a middle portion of the body frame 1 with its PC member 7 being uncovered by the PCM cover 8. As explained later in detail, the PCM cover 8 may be lifted by the lever 5 to expose and enable the PC member 7 to execute an image forming process when the body cover 2 is closed.

Figure 7:
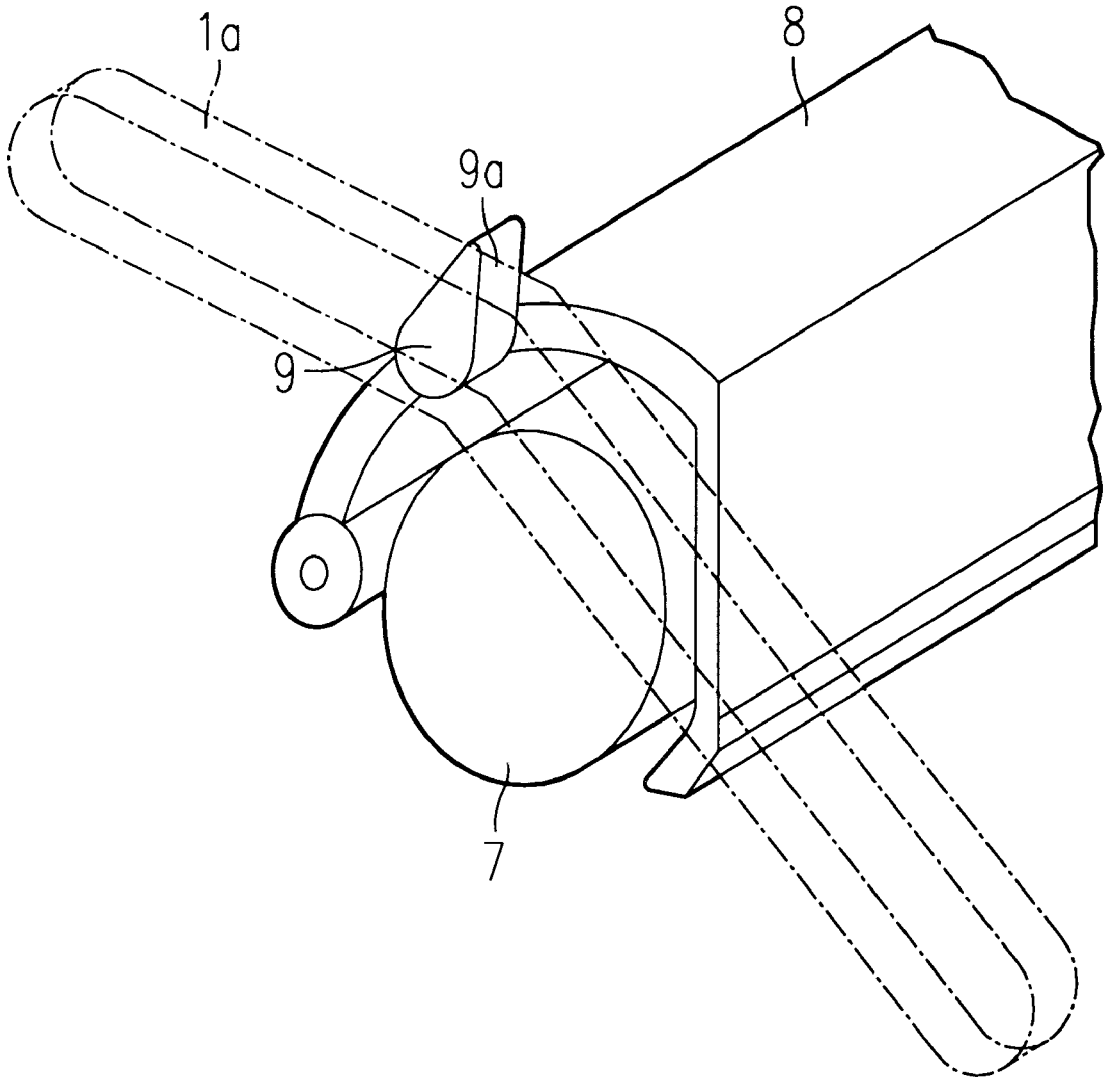
FIG. 7 is a schematic perspective view that illustrates another embodiment which includes a photo-conductive drum and a shield cover thereof to be opened by a movement of a lever.

A positional relation among the PC member 7, the PCM cover 8, and the guide slot 1*a,* and a construction thereof are illustrated in FIG. 7. The PCM cover 8 is biased by a spring (not shown) to keep the PC member 7 covered when the body cover 2 is opened.

Further, the PCM cover 8 includes a follower 9 mounted on its one side and protruding therefrom.

The protruding follower 9 includes a contact plane 9*a* facing the lowermost end of the guide slot 1*a,* and is positioned adjacent to the guide slot 1*a*. The protruding follower 9 may be positioned almost beside a bend in the guide slot 1*a* when the body cover is opened, as illustrated in FIG. 7. A fitting portion 5*a* has a cylindrical shape, as illustrated in FIGS. 1, 3A and 3B, and penetrates the guide slot 1*a* from an outer side to an inner side of the guide slot 1*a*. Thus, the cylindrical portion of the fitting portion 5*a* may contact the contact plane 9*a* during the opening/closing movement of the body cover.

Figure 8A:
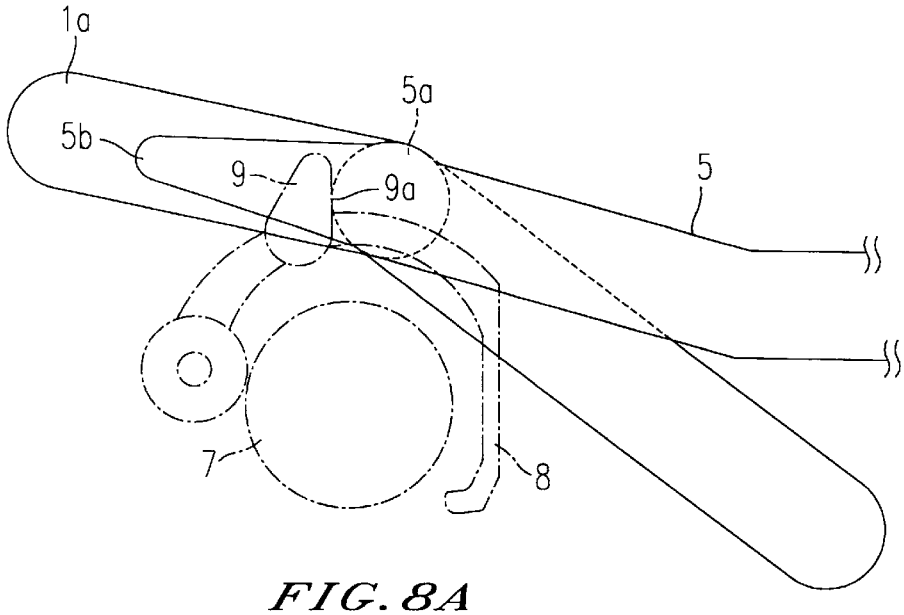
FIG. 8A is a side view that illustrates a first status of the lever illustrated in FIG. 7 when a fitting portion of the lever contacts the shield cover illustrated in FIG. 7.
Figure 8B:
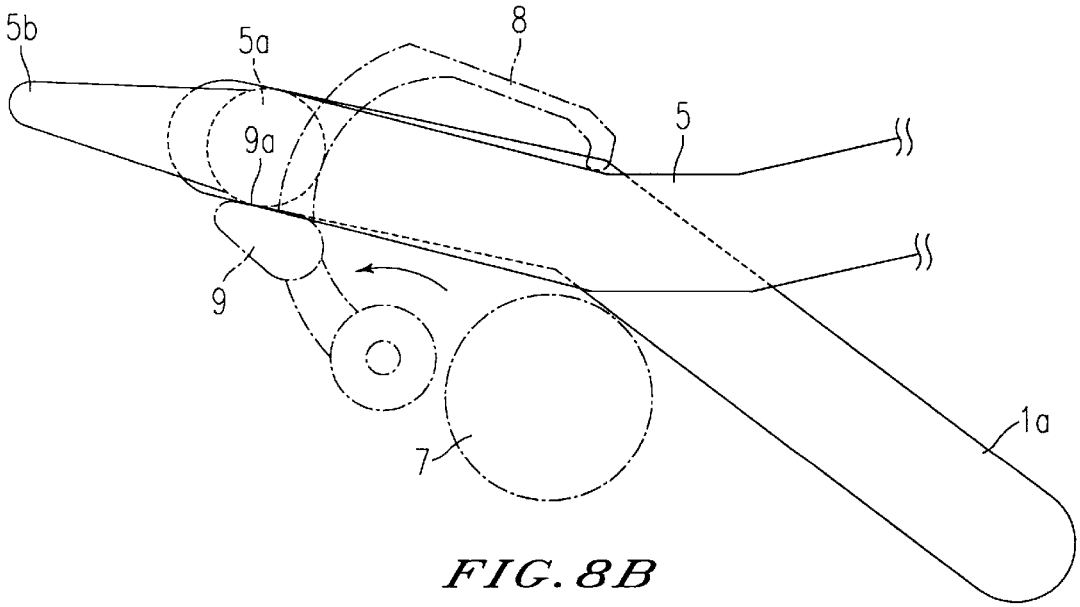
FIG. 8B is a side view that illustrates a second status of the lever illustrated in FIG. 7 when the shield cover is opened by the fitting portion illustrated in FIG. 8A.

A lifting process of the PCM cover 8 using the fitting portion 5*a* is illustrated in FIGS. 8A and 8B. As illustrated in FIG. 8A, the fitting portion 5*a* moves to a position adjacent to the bend of the guide slot 1*a* after the body cover starts closing. A head of the fitting portion 5*a,* which penetrates the guide slot 1*a,* may contact the contact plane 9*a*.

As illustrated in FIG. 8B, when the fitting portion 5*a* further upwardly moves corresponding to the closing movement of the body cover, a head pushes the PCM cover 8 so that the PCM cover 8 swings counterclockwise until the contact plane 9*a* becomes almost parallel with the lower half of the guide slot 1*a*. The head then slides on contact plane 9*a* and stops thereon. Thus, the PC member 7 is ready to start an image formation. FIG. 8B illustrates a condition of the body cover as it is almost completely closed.

According to this embodiment, the PCM cover 8 can be held at a prescribed constant position, even if the fitting portion 5*a* may vary its stopping position in the guide slot 1*a*. Because the contact plane 9*a* is held almost parallel with the lower half of the guide slot 1*a,* the head of the fitting portion 5*a* then slides thereon when the body cover is almost closed. Thus, a highly precise positioning of the lever 5 is not required.

Further, since the spring biases the PCM cover 8 in a prescribed direction, the PCM cover 8 can automatically return to its closing position when the body cover is opened.

The above-mentioned switch mechanism can be applied to an operational machine having a body cover, such as a paper shredder, besides the above-mentioned image forming apparatus.

Obviously, numerous additional modifications and variations of the present invention are possible in light of these teachings. It is therefore to be understood that, within the scope of the appended claims, the present invention may be practiced otherwise than as specifically described herein.

What is claimed as new and is desired to be secured by Letters Patent of the United States is:

1. An image forming apparatus having a body, comprising:

a body cover pivotally mounted on the body of said image forming apparatus; and a switch mechanism that detects an opening/closing status of said body cover, said switch mechanism including:

a switch for generating a signal indicating an opening/closing status of said body cover;

a cam disposed beside the switch, said cam activating said switch when rotated in a prescribed direction; and a lever with one end supported by the body cover, said lever rotating said cam by a prescribed constant amount of a rotational angle when the body cover is closed;

wherein said lever slides on a portion of the cam after the cam is rotated by the prescribed constant amount of a rotational angle when the body cover is almost closed.

2. An image forming apparatus as claimed in claim 1, wherein:

said cam includes a plate like portion and said lever includes a straight portion at a leading end portion which slides on the plate like portion.

3. An image forming apparatus as claimed in claim 2, wherein:

said switch includes an actuator and said cam includes a larger diameter portion that pushes the actuator by a prescribed length to activate the switch when rotated.

4. An image forming apparatus as claimed in claim 3, further comprising:

a guide slot that guides the lever back and forth during an opening/closing movement of the body cover; and a fitting member mounted on the lever, said member fitting into the guide slot.

5. An image forming apparatus as claimed in claim 4, wherein:

said guide slot has a leading end and a trailing end and said guide slot is bent almost at a middle portion thereof.

6. An image forming apparatus as claimed in claim 5, wherein:

said body cover stops its opening movement and is held open when the fitting member contacts the trailing end of the guide slot.

7. An image forming apparatus as claimed in claim 6, wherein:

said fitting member does not contact the leading end of the guide slot at an uppermost position.

8. An image forming apparatus as claimed in claim 2, further comprising:

a contacting surface disposed at the leading end portion of the lever, said surface contacting the plate like portion of the cam; and an engaging portion disposed beside the contacting surface, said engaging portion engaging with the plate like portion of the cam when the body cover is opened.

9. An image forming apparatus as claimed in claim 8, wherein:

said plate like portion includes a plane surface to be contacted by a slant portion of the lever and said plate like portion also includes a projection that projects from the plate like portion to be engaged with the engaging portion.

10. An image forming apparatus as claimed in claim 1, further comprising:

an image forming device disposed in the body; and a shield cover pivotally mounted on the image forming device to cover the image forming device.

11. An image forming apparatus as claimed in claim 10, wherein:

said shield cover has an engaging cam in the body, said engaging cam has a straight surface, said lever has a lifting member protruding therefrom that contacts and lifts the straight surface when the body cover is closed, and said lifting member slides on the straight surface and stops thereon after the shield cover is opened.

12. An image forming apparatus as claimed in claim 11, wherein:

said shield cover is biased in a prescribed direction to cover the image forming device, and said lifting member lifts the shield cover in a direction opposite to the prescribed direction.

13. An operational machine having a body, comprising:

a body cover pivotally mounted on the body of operational machine; and a switch mechanism that detects an opening/closing status of the body cover, said switch mechanism including:

a switch for generating a signal indicating an opening/closing status of the body cover;

a cam disposed beside the switch, said cam activating the switch when rotated in a prescribed direction; and a lever with one end supported by the body cover, said lever rotating the cam by a prescribed constant amount of a rotational angle when the body cover is closed;

wherein said lever slides on a portion of the cam after the cam is rotated by the prescribed constant amount of a rotational angle when the body cover is almost closed.

14. An operational machine as claimed in claim 13 wherein:

said cam includes a plate like portion and said lever includes a straight portion at a leading end portion which slides on the plate like portion.

15. An operational machine as claimed in claim 14, wherein:

said switch includes an actuator and said cam includes a larger diameter portion that pushes the actuator by a prescribed length to activate the switch when rotated.

16. An operational machine as claimed in claim 15, further comprising:

a guide slot that guides the lever back and forth during an opening/closing movement of the body cover; and a fitting member mounted on the lever, said member fitting into the guide slot.

17. An operational machine as claimed in claim 16, wherein:

said guide slot has a leading end and a trailing end and said guide slot is bent almost at a middle portion thereof.

18. An operational machine as claimed in claim 17, wherein:

said body cover stops its opening movement and is held open when the fitting member contacts the trailing end of the guide slot.

19. An operational machine as claimed in claim 17, wherein:

said fitting member does not contacts the leading end at an uppermost position.

20. An operational machine as claimed in claim 14, further comprising:

a contacting surface disposed at the leading end portion of the lever, said surface contacting the plate like portion of the cam; and an engaging portion disposed beside the contacting surface at the leading end portion, said engaging portion engaging the plate like portion of the cam when the body cover is opened.

21. An operational machine as claimed in claim 20, wherein:

said plate like portion includes a plane surface to be contacted by a slant portion of the lever and said plate like portion also includes a projection that projects from the plate like portion to be engaged with the engaging portion.

22. An image forming apparatus having a body, comprising:

a body cover means for covering the body of the image forming apparats, said body cover means being pivotally mounted on the body; and means for detecting an opening/closing status of the body cover means, said detecting means including:

switch means disposed in the body;

means for activating the switch means when moved in a prescribed direction, said activating means being positioned adjacent to the switch means; and means for moving the activating means by a prescribed constant amount when the body cover means is closed;

wherein said moving means includes a lever and has one end supported by the body cover means;

means for forming an image; and means for covering the image forming means, said covering means including engaging means in a body having a straight surface;

wherein said moving means include lifting means for contacting and lifting the engaging means when the body cover means are closed.

23. An image forming apparatus as claimed in claim 22, wherein:

said lifting means slide on the engaging means after the body cover means are opened.

24. An image forming method, comprising the steps of:

providing a body cover pivotally mounted on a body of an image forming apparatus;

providing in the body a switch that generates a signal indicating an opening/closing status of the body cover;

providing a cam beside the switch, said cam activating the switch when rotated in a prescribed direction;

providing a lever with one end supported by the body cover;

rotating the cam by a prescribed constant amount of a rotational angle using the lever when the body cover is closed; and sliding the lever on a portion of the cam after the cam is rotated by the prescribed constant amount of a rotational angle.

25. An image forming method, comprising the steps of:

providing a body cover pivotally mounted on a body of an image forming apparatus;

providing in the body a switch that generates a signal indicating an opening/closing status of the body cover;

providing a cam beside the switch, said cam activating the switch when rotated in a prescribed direction;

providing a lever with one end supported by the body cover;

rotating the cam by a prescribed constant amount of a rotational angle using the lever when the body cover is closed;

providing a plate like portion on the cam;

providing a straight portion on a leading end portion of the lever; and sliding the straight portion on the plate like portion after the cam is rotated by the prescribed constant amount of a rotational angle.

26. An image forming method, as claimed in claim 25, further comprising the steps of:

providing a guide means for guiding the lever back and forth during an opening/closing movement of the body cover; and providing a fitting member on the lever for fitting into the guide means.

27. An image forming method, comprising the steps of:

providing a body cover pivotally mounted on a body of an image forming apparatus;

providing in the body a switch that generates a signal indicating an opening/closing status of the body cover;

providing a cam beside the switch, said cam activating the switch when rotated in a prescribed direction;

providing a lever with one end supported by the body cover;

rotating the cam by a prescribed constant amount of a rotational angle using the lever when the body cover is closed;

providing a contact surface on a leading end portion of the lever, said surface contacting a plate like portion of the cam; and providing an engaging portion beside the contacting surface on the leading end portion, said engaging portion engaging the plate like portion when the body cover is opened.

28. An image forming method as claimed in claim 27, further comprising the steps of:

providing a plane surface to be contacted by a slant portion on the plate like portion; and providing a projection means for projecting from the plate like portion to be engaged with the engaging portion.

29. An image forming method, comprising the steps of:

providing a body cover pivotally mounted on a body of an image forming apparatus;

providing in the body a switch that generates a signal indicating an opening/closing status of the body cover;

providing a cam beside the switch, said cam activating the switch when rotated in a prescribed direction;

providing a lever with one end supported by the body cover;

rotating the cam by a prescribed constant amount of a rotational angle using the lever when the body cover is closed;

providing an image forming unit in the body of the image forming apparatus;

providing a shield cover pivotally mounted on the image forming unit, said shield cover covering the image forming unit;

providing an engaging cam on the shield cover;

providing a straight surface on the engaging cam;

providing a lifting member protruding from the lever;

lifting the shield cover using the lifting member when the body cover is closed;

sliding the lifting member on the straight surface after the shield cover is opened; and stopping the lifting member on the straight surface.

30. An image forming apparatus having a body, comprising:

a body cover pivotally mounted on the body of said image forming apparatus; and a switch mechanism that detects an opening/closing status of said body cover, said switch mechanism including:

a switch for generating a signal indicating an opening/closing status of said body cover;

a cam disposed beside the switch, said cam activating said switch when rotated in a prescribed direction; and a lever with one end supported by the body cover, said lever rotating said cam by a prescribed constant amount of a rotational angle when the body cover is closed;

wherein said one end of the lever is attached to a prescribed portion of the body cover such that a portion of the lever extending from the body to an outside thereof when the body cover is opened is almost hidden by a hollow portion of the body cover.

31. An operational machine having a body, comprising:

a body cover pivotally mounted on the body of the operational machine; and a switch mechanism that detects an opening/closing status of the body cover, said switch mechanism including:

a switch for generating a signal indicating an opening/closing status of the body cover;

a cam disposed beside the switch, said cam activating the switch when rotated in a prescribed direction; and a lever with one end supported by the body cover, said lever rotating the cam by a prescribed constant amount of a rotational angle when the body cover is closed;

wherein said one end of the lever is attached to a prescribed portion of the body cover such that a portion of the lever extending from the body to an outside thereof when the body cover is opened is almost hidden by a hollow portion of the body cover.

* * * * *